US008739882B2

(12) United States Patent
Sten-Halvorsen et al.

(10) Patent No.: US 8,739,882 B2
(45) Date of Patent: Jun. 3, 2014

(54) SUBSEA COOLER

(75) Inventors: Vidar Sten-Halvorsen, Kongsberg (NO); Erik Baggerud, Jar (NO); Terje Hollingsaeter, Lommedalen (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 1158 days.

(21) Appl. No.: 12/451,815

(22) PCT Filed: Jun. 2, 2008

(86) PCT No.: PCT/NO2008/000196

§ 371 (c)(1),
(2), (4) Date: May 10, 2010

(87) PCT Pub. No.: WO2008/147219

PCT Pub. Date: Dec. 4, 2008

(65) Prior Publication Data

US 2010/0252227 A1 Oct. 7, 2010

(30) Foreign Application Priority Data

Jun. 1, 2007 (NO) ..... 20072798

(51) Int. Cl.
*E21B 7/12* (2006.01)

(52) U.S. Cl.
USPC ..... 166/357; 166/344; 166/351; 166/368

(58) Field of Classification Search
USPC ..... 166/344, 351, 357, 368, 302, 369, 166/75.12
See application file for complete search history.

(56) References Cited

U.S. PATENT DOCUMENTS

| | | | | |
|---|---|---|---|---|
| 1,971,695 | A * | 8/1934 | Ploeger | 62/212 |
| 2,639,774 | A * | 5/1953 | Rhoads | 166/57 |
| 2,666,692 | A * | 1/1954 | Dolezal et al. | 422/652 |
| 2,937,506 | A * | 5/1960 | Stirlen | 62/121 |
| 2,979,308 | A * | 4/1961 | Putney | 165/108 |
| 3,404,537 | A * | 10/1968 | Leonard, Jr | 62/123 |
| 3,643,736 | A * | 2/1972 | Talley, Jr. | 166/356 |
| 3,648,767 | A * | 3/1972 | Balch | 165/104.19 |
| 3,856,078 | A | 12/1974 | Dahl | |
| 3,908,763 | A * | 9/1975 | Chapman | 166/302 |
| 3,958,427 | A * | 5/1976 | Rath et al. | 62/62 |
| 4,050,252 | A * | 9/1977 | Nakanishi | 60/641.6 |
| 4,112,687 | A * | 9/1978 | Dixon | 60/641.6 |
| 4,315,408 | A * | 2/1982 | Karl | 62/50.7 |
| 4,324,375 | A * | 4/1982 | O'Neill | 244/171.8 |
| 4,327,801 | A * | 5/1982 | Koizumi et al. | 165/104.21 |
| 4,339,929 | A * | 7/1982 | Fitzpatrick et al. | 62/79 |
| 4,363,703 | A * | 12/1982 | ElDifrawi et al. | 203/10 |

(Continued)

FOREIGN PATENT DOCUMENTS

| | | |
|---|---|---|
| DE | 26 13 835 A1 | 10/1976 |
| GB | 1 487 023 | 9/1977 |

(Continued)

*Primary Examiner* — Matthew Buck
*Assistant Examiner* — Aaron Lembo

(57) ABSTRACT

The present invention regards a subsea cooling unit having an inlet for a hot fluid and an outlet for cooled fluid, the cooling unit comprising a number of coils exposed to seawater, and means for generating a flow of seawater past the coils, where the means for generating the flow of seawater comprises a propeller and a rotatable actuator and that the cooler is enclosed in a duct.

22 Claims, 4 Drawing Sheets

(56) References Cited

U.S. PATENT DOCUMENTS

| | | | | | |
|---|---|---|---|---|---|
| 4,378,846 | A * | 4/1983 | Brock | 166/303 |
| 4,438,806 | A * | 3/1984 | Kaehler | 165/108 |
| 4,501,525 | A * | 2/1985 | Grundy et al. | 141/279 |
| 4,506,735 | A * | 3/1985 | Chaudot | 166/357 |
| 4,533,526 | A * | 8/1985 | Delacour et al. | 423/1 |
| 4,537,247 | A * | 8/1985 | Okamoto et al. | 165/104.14 |
| 4,836,123 | A * | 6/1989 | Grinde et al. | 114/382 |
| 4,976,308 | A * | 12/1990 | Faghri | 165/10 |
| 5,044,440 | A * | 9/1991 | Stinessen et al. | 166/344 |
| 5,232,636 | A * | 8/1993 | Cates et al. | 261/4 |
| 5,462,430 | A * | 10/1995 | Khinkis | 431/10 |
| 5,536,893 | A * | 7/1996 | Gudmundsson | 585/15 |
| 5,795,198 | A * | 8/1998 | Pedone | 440/2 |
| 5,803,161 | A * | 9/1998 | Wahle et al. | 165/104.21 |
| 5,878,814 | A * | 3/1999 | Breivik et al. | 166/267 |
| 5,908,338 | A * | 6/1999 | Kawasaki et al. | 440/89 R |
| 6,068,053 | A * | 5/2000 | Shaw | 166/267 |
| 6,142,215 | A * | 11/2000 | Paulsen et al. | 165/45 |
| 6,313,545 | B1 * | 11/2001 | Finley et al. | 290/54 |
| 6,450,247 | B1 * | 9/2002 | Raff | 165/45 |
| 6,679,655 | B2 * | 1/2004 | Bonn | 405/184.4 |
| 6,692,319 | B2 * | 2/2004 | Collier et al. | 440/66 |
| 6,703,534 | B2 * | 3/2004 | Waycuilis et al. | 585/15 |
| 6,776,227 | B2 * | 8/2004 | Beida et al. | 166/61 |
| 6,776,825 | B2 * | 8/2004 | Betting et al. | 96/389 |
| 6,932,121 | B1 * | 8/2005 | Shivers, III | 141/1 |
| 6,998,724 | B2 * | 2/2006 | Johansen et al. | 290/1 R |
| 7,005,756 | B2 * | 2/2006 | Westerbeke, Jr. | 290/1 A |
| 7,037,105 | B2 * | 5/2006 | Hayes | 432/63 |
| 7,121,219 | B1 * | 10/2006 | Stallings | 114/151 |
| 7,448,223 | B2 * | 11/2008 | Darling et al. | 62/50.7 |
| 7,530,398 | B2 * | 5/2009 | Balkanyi et al. | 166/344 |
| 7,654,328 | B2 * | 2/2010 | Stinessen et al. | 166/356 |
| 7,898,102 | B2 * | 3/2011 | Alstot et al. | 290/54 |
| 8,256,519 | B2 * | 9/2012 | Friedemann | 166/335 |
| 2004/0238161 | A1 | 12/2004 | Al-Anizi et al. | |
| 2007/0152452 | A1 * | 7/2007 | Finley et al. | 290/54 |
| 2010/0006291 | A1 * | 1/2010 | Poorte | 166/302 |
| 2010/0200231 | A1 * | 8/2010 | Minnich | 166/272.3 |
| 2010/0244450 | A1 * | 9/2010 | Tabe | 290/53 |
| 2012/0073823 | A1 * | 3/2012 | McClanahan et al. | 166/344 |
| 2012/0097362 | A1 * | 4/2012 | Kanstad et al. | 165/45 |

FOREIGN PATENT DOCUMENTS

| | | | |
|---|---|---|---|
| WO | WO 97/23708 | A1 | 7/1997 |
| WO | WO 2005/078233 | A1 | 8/2005 |
| WO | WO 2007/045718 | A2 | 4/2007 |

* cited by examiner

SUBSEA COOLER

FIELD OF THE INVENTION

The following invention relates to a subsea cooler for cooling a hot fluid as a fluid stream produced from one or more subsea wells, flowing through a pipe by using the surrounding seawater as the coolant medium. The invention also relates to a cooling unit comprising at least one coil and means for providing a flow of cooling fluid past the coils. The invention also relates to a method for cooling a hot fluid as a fluid stream produces from one or more subsea wells.

BACKGROUND OF THE INVENTION

The fluid produced from a hydrocarbon well is at times very hot, sometimes over one hundred degrees centigrade. If the wells are a long distance away from a processing facility it may be necessary to boost the flow by introducing a pump in the flowline. A pump will work better if the fluid is cooled. This is especially important when the fluid is a gas and a compressor is employed. The efficiency of a compressor is very dependent upon the temperature of the gas, i.e. the cooler the gas the more efficient the compressor will be.

A well known cooling device is the radiator where a flow of cool air is forced against a piping arrangement that presents a large surface area to the air.

SUMMARY AND OBJECTS OF THE INVENTION

The present invention regards a cooling unit, a subsea cooling unit and a method for subsea cooling of a fluid as defined in the attached claims.

According to the invention there is in one aspect provided a subsea cooling unit having an inlet for a hot fluid stream and an outlet for cooled fluid. The fluid stream will normally be a fluid stream produced from one or more subsea wells. The cooling unit comprising a number of coils exposed to seawater for cooling of the hot fluid, and means for generating a flow of seawater past the coils. According to the invention the means for generating the flow of seawater comprises a propeller and a rotatable actuator. The propeller is arranged such that when the propeller is operated it creates the desired flow of seawater past the coils positioned in the seawater. According to the invention the cooling unit is also enclosed in a duct, or at least the coils of the cooling unit is positioned in the duct. Such a configuration will assist in guiding a flow of seawater past the coils.

According to one aspect of the invention the duct may have an inlet with reduced diameter. The inlet may have a reduced inlet compared with the rest of the duct. The propeller may be located in the inlet or in connection with the inlet. The reduced diameter may be formed as a funnel. The smaller end of the funnel may be facing away from the coils in the cooler or possibly be arranged in an opposite manner. The propeller may be arranged by the smallest diameter of the inlet.

According to another aspect the cooling unit may comprise a controller. The controller may be connected to the different parts of the cooling unit to regulate the different parts in relation to each other to achieve the desired cooling of the fluid.

According to a further aspect the actuator may be an electric motor. In another aspect there may be a power cable extending from a remote location. In another embodiment the power may be a battery pack attached to the cooling unit or the power may be supplied in another manner. The battery pack may be replaceable or attachable or attached to means to periodically or continuously charge the battery pack.

According to second aspect of the invention there is provided a cooling unit having an inlet for a hot fluid and an outlet for the cooled fluid. This fluid may be a fluid produced from one or more wells, it may be a lubricant for lubrication of a subsea motor, it may be a gas stream or it may be another fluid needing cooling. The cooling unit may be positioned subsea. According to the invention the cooling unit comprises a number of coils exposed to a cooling fluid for cooling of the hot fluid, and means for generating a flow of cooling fluid past the coils, where the means for generating the flow of cooling fluid comprises a propeller and a rotatable actuator and the cooling unit is enclosed in a duct. With enclosed in a duct, at least the coils of the cooling unit is enclosed in a duct. The power for operation of the actuator is generated from the fluid stream. The cooling fluid may be seawater or it may be a fluid arranged in a closed loop. The fluid in the closed loop may according to one aspect be connected to a cooling unit according to the invention and thereby exposed to the temperature of surrounding seawater if it is a subsea cooling unit, or the closed loop it self may be exposed to the seawater as such, or cooled in a different manner.

According to an aspect of this embodiment of the invention a propeller may be located in the hot fluid. This propeller will thereby be positioned within a pipe for the hot fluid. This propeller in the hot fluid may be operatively connected to power generating means located outside of the pipe for the hot fluid. According to one aspect the propeller may be operatively connected with a second propeller located in the cooling fluid stream. In one embodiment the first and second propellers, hence in the cooling fluid and hot fluid, may be mechanically connected, in another embodiment they may be connected by energy lines, with a generator arranged on one propeller an a motor arranged on the other propeller. In another embodiment there first and second propeller may be arranged with a common rotational axis, as ring propellers. The second propeller will thereby act as the rotatable actuator.

The present invention also relates to a method for subsea cooling of at least a part of a fluid stream produced from one or more subsea wells, where at least a part of the fluid is guided into an inlet and through a number of coils arranged in a duct, and then through an outlet, where the coils are exposed to seawater for heat exchanging with the fluid, where the seawater is driven past the coils arranged in the duct by a propeller.

BRIEF DESCRIPTION OF THE DRAWINGS

The invention will now be described with reference to the accompanying drawing where.

DESCRIPTION OF THE PREFERRED EMBODIMENTS

Figure 1:
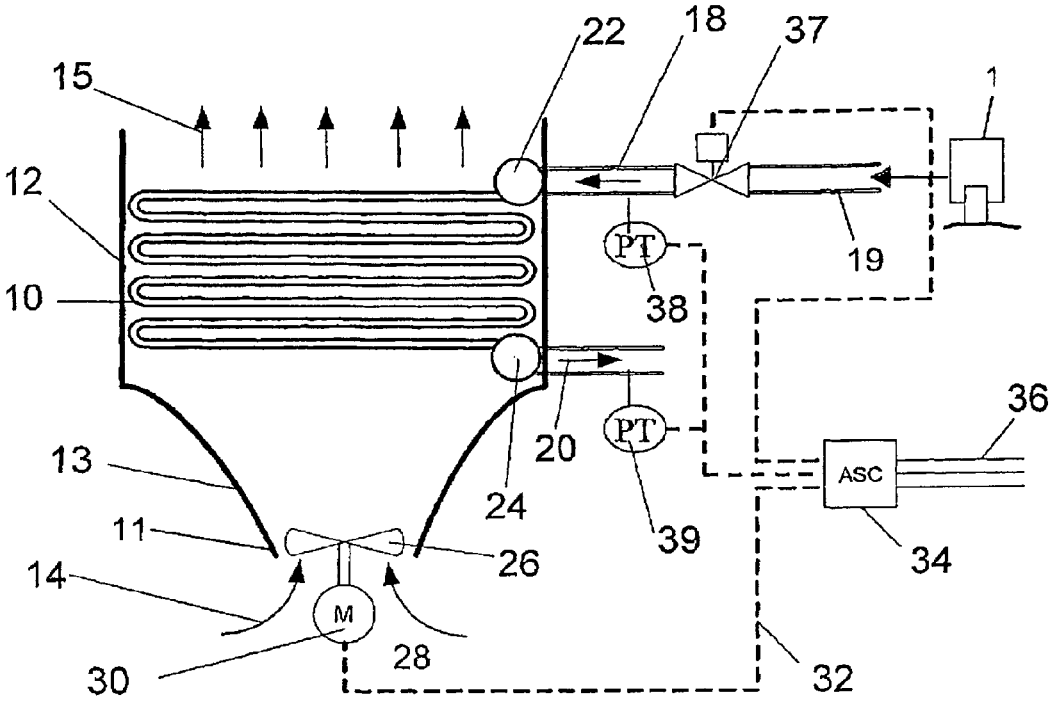
FIG. 1 is a drawing showing the principle of the invention

In FIG. 1 there is shown a cooling unit, or called a cooler, in the form of a piping arrangement 10 which may consist of one or more pipes that may be arranged as a number of individual coils to achieve the greatest possible surface area. The piping arrangement is connected to an inlet pipe 18 and an outlet pipe 20. When the cooler is made up in more than one coil, the inlet pipe is connected to a distribution unit 22 that distributes the flow from the inlet pipe into an individual coil of the cooler. Likewise, as the fluid leaves the coils each flow is gathered in a unit 24 at the outlet pipe 20. The piping arrangement of the cooler is not shown in detail since such coil systems are well known to those skilled in the art and such persons will be able to determine the number and size of pipes necessary for maximum efficiency, i.e. the amount of cooling desired. In a subsea system the inlet pipe 18 will be connected to a flowline 19 that transports a hot hydrocarbon fluid from one or more subsea wells 1 and into the cooler. The purpose of the cooler is to cool the hot fluid by utilizing the cold seawater surrounding the cooler as the cooling medium. Seawater at depth is quite cold, close to zero centigrade.

The free flow of seawater may be too slow to enable efficient cooling of the hot fluid. The invention therefore proposes to include means to increase the flow of the seawater past the coils 10. To this end a propeller 26 is located in front of the cooler. The propeller is rotated by a rotating actuator or motor 30 via a shaft 28. The motor is supplied with power (electric or hydraulic) through a line 32. A controller 34 receives signals and power through umbilical 36 that in turn extends to a remote control station. The remote control station may be located on a floating production unit or a land station. When the propeller is rotated it will force a stream of seawater past the coils of the cooler 10. The propeller may as an alternative be arranged downstream of the coils, and thereby draw seawater past the coils.

To further enhance the cooling effect the cooler is enclosed by an open-ended duct 12. The duct is at one side connected to a funnel 13. The funnel has at its other side an inlet 11 with an opening diameter that is substantially of the same size as the propeller 26, as shown in FIG. 1. The cooling medium, i.e. sea water, is by the propeller 26 forced to flow through the cooler as shown by arrows 14 and 15, respectively. In another embodiment of the invention the duct may form part of a closed system for the cooling fluid. The cooling fluid may thereby be another fluid than seawater.

In the piping inlet 18 there is arranged a valve 37 which is controlled by the controller 34. Also in the inlet 18 and the outlet 20 there are pressure and temperature transmitters 38, 39 respectively, also connected to the controller 34.

The positions of the piping inlet and outlet may be reversed such that the inlet is closest to the propeller.

In the controller 34 there may be arranged an electrical storage device such as a battery (not shown) to enable the motor 30 to be powered even in the event that the power supply from the control station fails.

The temperature transmitters 38 and 39 measure the temperatures and pressures of the fluid at the piping inlet 18 and outlet 20. This enables the control of the temperature of the fluid at the outlet and to regulate the temperature to achieve a desired level and to maintain a constant outlet temperature. Also by measuring the pressure at the outlet and inlet it is possible to gain information about the flow of fluid and to calculate the amount of flow.

In the event that the fluid is a gas the subsea system will generally include a gas compressor to boost the gas flow. In this case it is important that the gas compressor is fed the gas at a uniform temperature as this increases the efficiency of the compressor. With the temperature data the controller 34 may regulate the speed of the motor 30 so that the desired temperature in the gas fed to the compressor is uniform at all times.

Figure 3:
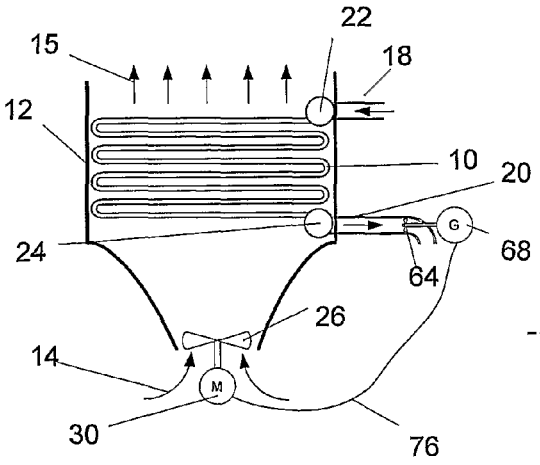
FIG. 3 is a drawing showing an embodiment of the invention.
Figure 4:
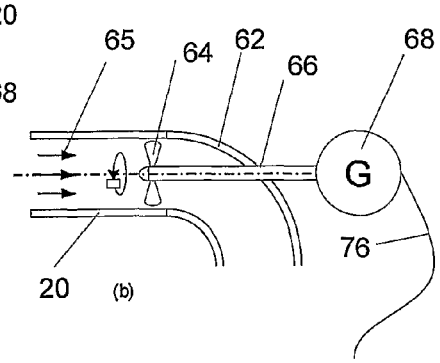
FIG. 4 is a detail drawing of FIG. 3.

In an embodiment of the invention the power to drive the propeller 26 is derived from the energy in the fluid stream. This is shown in FIG. 3 and FIG. 4. The outlet pipe 20 for the hot fluid has a bend 62. In the straight part of the bend there is arranged a propeller 64. The propeller 64 is attached to a shaft 66 that extends through the wall of the pipe bend and is at its other end connected to the rotor (not shown) of a generator 68. An electric cable 76 connects the generator 68 with the controller 34 and hence the motor 30. When the gas flows through the pipe, as shown by arrows 65, it will cause the propeller 64 to rotate which in turn generates electrical power in generator 68. The power is passed through cable 76 to controller 34 which in turn feeds power as necessary to the electric motor 30. When motor 30 is powered it will cause the propeller 26 to rotate, thus increasing the flow of coolant medium past the cooler unit 10.

Figure 2:
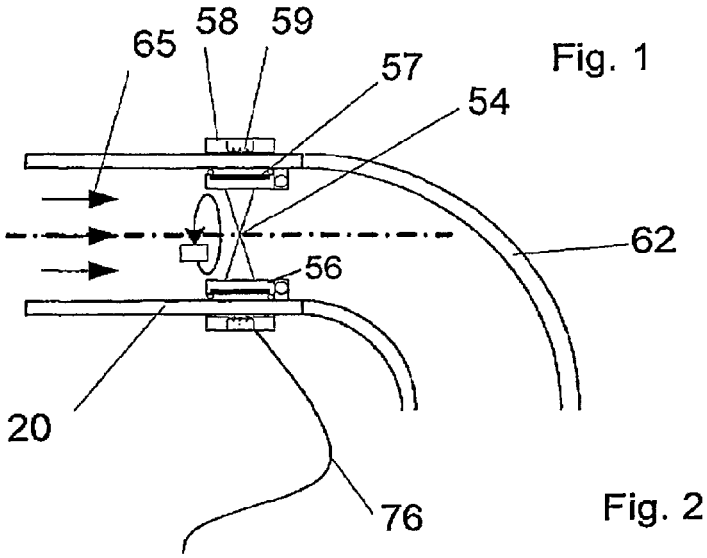
FIG. 2 is a detail showing an alternative power generating device

Alternatively the propeller may be in the form of a ring propeller that induces a current in coils located around the outer periphery of the pipe 20. This is shown in FIG. 2. A propeller 54 includes an outer ring 56 which is supported by bearings (not shown) so that it will rotate when fluid flows past the propeller. In the ring there is a number of magnets 57. Around the outer periphery of the pipe 20 there is another ring 58 with magnetic coils 59. The outer magnetic ring generates electrical current when the propeller ring rotates, as is well known in the art. The current is passed through cable 76 to the controller 34 which in turn controls the feed of power to the electric motor 30.

Preferably the controller 34 includes one or more electrical storage devices such as batteries (not shown) to act as a buffer between the generator and the motor. This enables the propeller 26 to be rotated as needed and act as a power reserve when the generator is not running, because there is no flow past propeller 64. the batteries may also be charged by the propeller.

Figure 5:
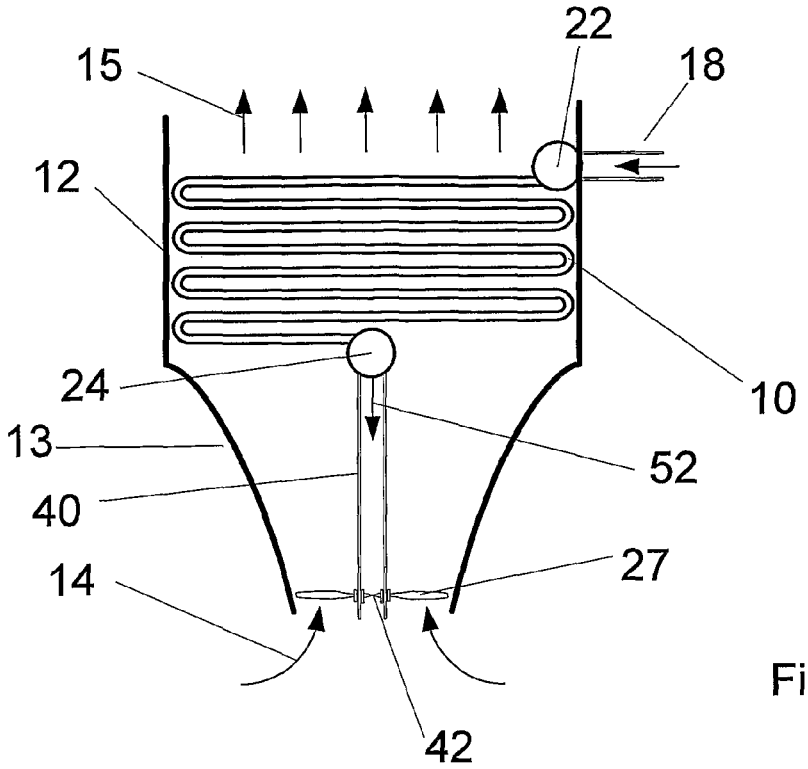
FIG. 5 is a drawing showing a second embodiment of the invention.
Figure 6:
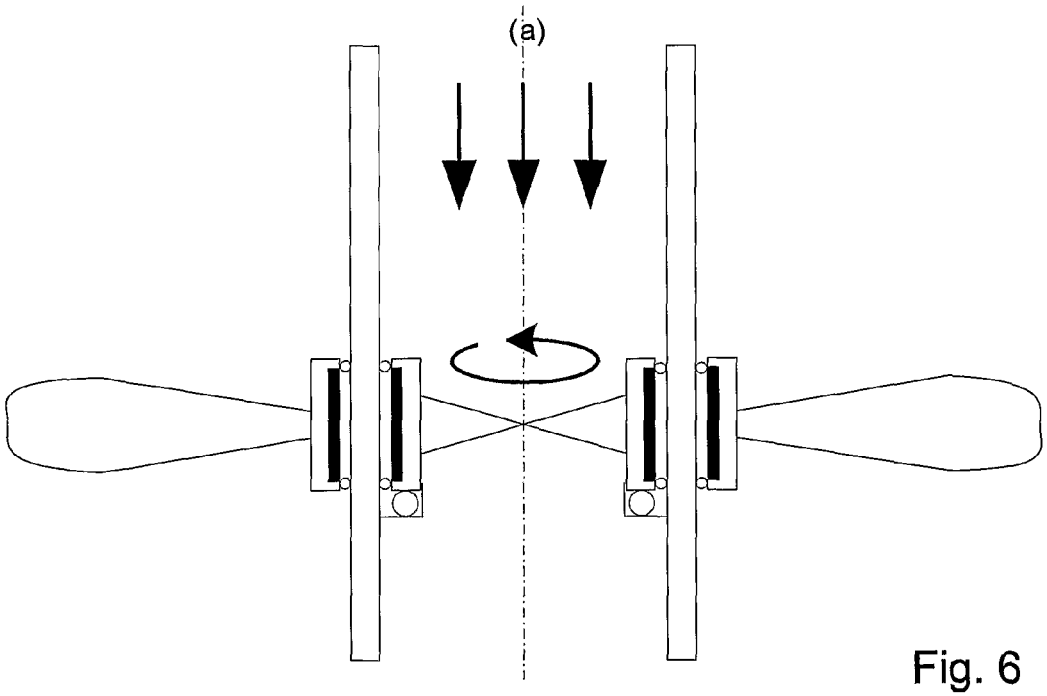
FIG. 6 is a detail drawing of FIG. 5.

In yet another embodiment of the invention the propeller 26 is directly connected to a second propeller located in either the fluid inlet or outlet pipe. In a first alternative of this embodiment shown in FIGS. 5 and 6 the first propeller 27 is a ring propeller, similar to the one shown in FIG. 2. The fluid outlet pipe 40 is in this case is located centrally in the funnel 13. When a propeller 42 is rotated by the flow of fluid, as indicated by arrow 52, the propeller 27 will also be forced to rotate, in a similar manner as described with relation to FIG. 2.

Figure 7:
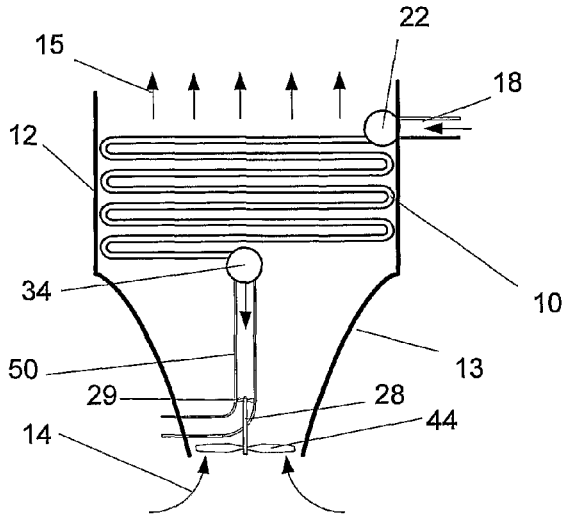
FIG. 7 is a drawing showing a third embodiment of the invention.
Figure 8:
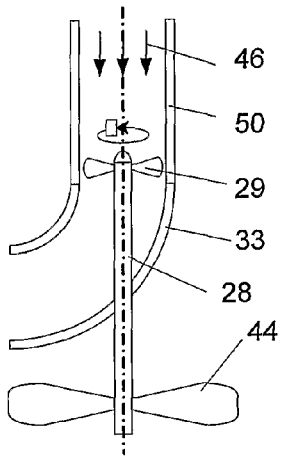
FIG. 8 is a detail drawing of FIG. 7.

In an alternative of the above embodiment shown in FIGS. 7 and 8 a propeller 29 is mechanically connected with a second propeller 44. This is in principle similar to the embodiment shown in FIG. 3. The propeller 29 is located in a bend 33 of an outlet pipe 50. The propeller 26 is fastened to a shaft 28 which extends through the wall of the pipe 50 at the bend 33 and is at its other end connected to the second propeller 44 which is located in the inlet of funnel 13.

When the hot fluid is pumped through the outlet pipe 50, as shown by arrows 46, it will cause the propeller 29 to rotate which in turn causes the propeller 44 to rotate. The rotation of propeller 44 will propagate a flow of cold seawater past the cooler 10

Figure 10:
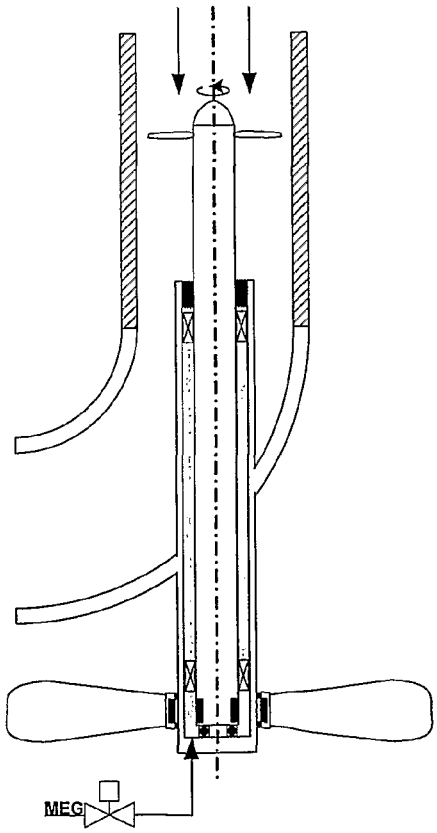
FIG. 10 is a drawing of an alternative embodiment of that shown on FIGS. 4 and 8.

In an alternative design of the shaft 28 shown in FIG. 10 the shaft is enclosed in a pipe that is welded or otherwise fixed to the bend. The shaft rotates on bearings inside the pipe. The advantage with this design is that grease can be supplied to the annulus between the shaft and the pipe to protect the bearings and to avoid hydrocarbons leaking out to the environment. The supply of grease is controlled by a valve as shown. This design may also be used in the embodiment shown in FIG. 4.

The invention is intended for use with a subsea separation system where cooling of the produced hydrocarbons gas is an advantage for increasing the efficiency of a gas compressor. The efficiency of a compressor is related to the temperature of the fluid and it is desirable to lower this temperature as far as possible.

Figure 9:
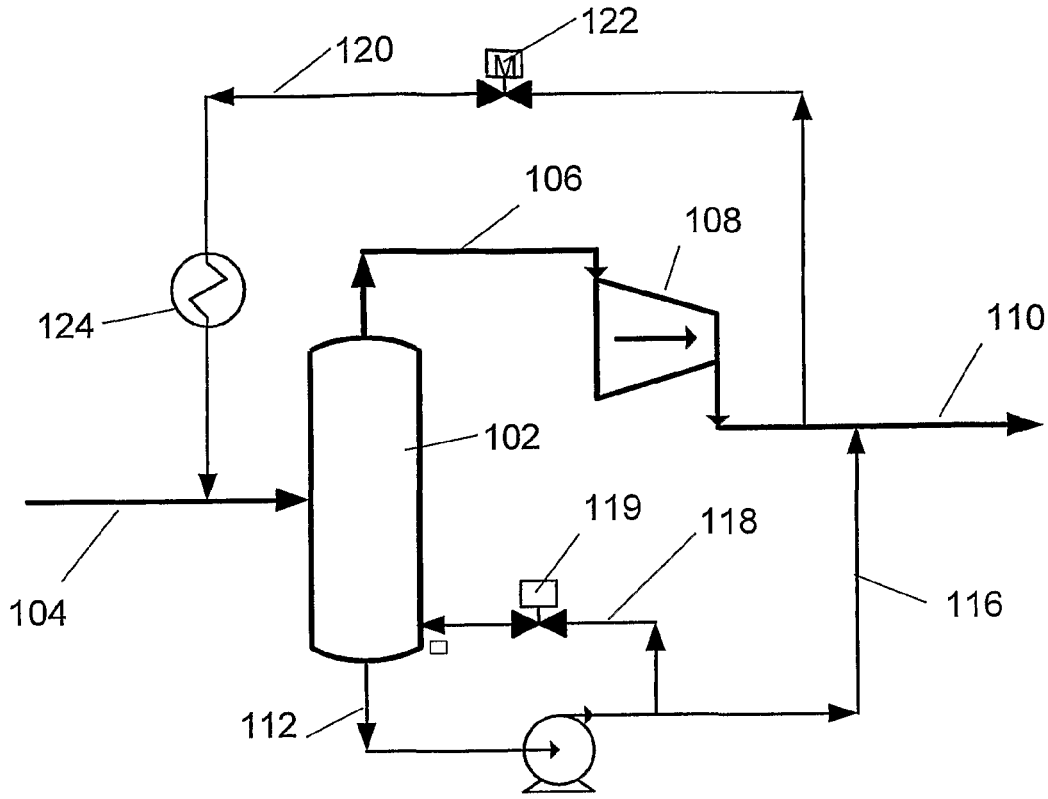
FIG. 9 is a schematic of a subsea separation system.

In FIG. 9 there is shown a subsea separation and boosting system where the invention may find particular use. In a gas separation and compression system with rotating machinery there is a need for a safety system that can recirculate the fluid to ensure a minimum volume stream through the compressor at all times. This is especially necessary at start-up or if there are disturbances in the process that creates a lower fluid flow trough the compressor. If this persists there is also a potential for a temperature rise in the fluid that may limit the operations or even create a dangerous situation. To reduce this risk a cooler should be included in the recirculation circuit.

A special condition exists when the need for cooling comes suddenly, as in an anti-surge situation.

To this end FIG. 9 shows a subsea process system for hydrocarbons produced by one or more wells. The system comprises a separator 102 being fed from a flowline 104.

The separated gas is conveyed through pipe 106 to a compressor 108 which in turn is connected to an export flowline 110. Liquids separated from the gas in the separator 102 are conveyed through pipe 112 to a pump 114 and thence to flowline 116. Flowline 116 may connect to flowline 110 or be a separate flowline to a process facility. A liquid bypass 118 having a valve 119 may form a reverse circuit between flowline 116 and separator 102. An anti-surge bypass 120 connects the compressor 108 outlet with the flowline 104. In the bypass 120 there is located an anti-surge valve 122 and a cooler 124. The cooler may be any of the kinds previously described or according to the attached claims. If so desired a cooler may also be incorporated into liquid bypass 118.

The invention has now been explained with different embodiments. A skilled person will understand that there may be made several alterations and modifications to the embodiments within the scope of the invention as defined in the attached claims.

The invention claimed is:

1. A subsea cooling unit comprising:

a piping arrangement which includes a fluid inlet for a fluid stream produced from one or more subsea wells, a fluid outlet for the fluid stream, and a number of coils which are connected between the fluid inlet and the fluid outlet;

a duct in which the coils are housed, the duct being submerged in the sea and including a duct inlet and a duct outlet which are submerged in the sea such that the coils are also submerged in the sea;

means for generating a flow of seawater past the coils, said means including a propeller which is located in the duct and is rotated by an actuator;

wherein as the fluid stream flows through the coils the seawater flows through the duct and over the coils to cool the fluid stream.

2. The cooling unit according to claim 1, wherein the duct inlet comprises a reduced diameter and the propeller is located in the duct inlet.

3. The cooling unit according to claim 1, further comprising a controller which controls the actuator to vary the flow of seawater through the duct.

4. The cooling unit according to claim 1, wherein the actuator is an electric motor which is powered through a power cable extending from a remote location.

5. A cooling unit for cooling a fluid stream which comprises:

a piping arrangement which includes a fluid inlet for the fluid stream, a fluid outlet for the fluid stream, and a number of coils which are positioned in a duct and are connected between the fluid inlet and the fluid outlet; and a first propeller which is positioned in the duct and which when rotated generates a flow of cooling fluid past the coils; and means for rotating the first propeller, said rotating means including a second propeller which is positioned in either the fluid inlet or the fluid outlet;

wherein the fluid stream rotates the second propeller to thereby power the first propeller.

6. The cooling unit according to claim 5, wherein the fluid stream is a gas stream.

7. The cooling unit according to claim 5, wherein the second propeller is operatively connected to a generator which powers a motor that rotates the first propeller.

8. The cooling unit according to claim 5, wherein the first and second propellers are mechanically connected such that rotation of the second propeller rotates the first propeller.

9. The cooling unit according to claim 5, wherein the fluid stream comprises a well fluid stream produced from one or more subsea wells.

10. A method for subsea cooling of a fluid stream produced from one or more subsea wells, the method comprising:

directing the fluid stream into a fluid inlet, through a number of coils housed in a duct, and then through a fluid outlet, said duct being submerged in the sea and comprising a duct inlet and a duct outlet which are submerged in the sea such that the coils are also submerged in the sea; and driving the seawater through the duct and past the coils with a propeller to thereby enable the seawater to absorb heat from the fluid stream, said propeller being located in the duct.

11. A subsea cooling apparatus for cooling a fluid stream with seawater, the cooling apparatus comprising:

a pipe arrangement through which the fluid stream is directed;

a duct within which at least a portion of the pipe arrangement is housed, said duct being submerged in the sea and comprising a duct inlet and a duct outlet which are submerged in the sea such that said portion of the pipe arrangement is also submerged in the sea;

a first propeller which when rotated generates a flow of seawater through the duct and over said portion of the pipe arrangement, said first propeller being located within the duct; and means for rotating the first propeller.

12. The subsea cooling apparatus of claim 11, wherein the rotating means comprises a motor which is connected to the first propeller.

13. The subsea cooling apparatus of claim 12, wherein the motor is powered by a generator which is energized by a second propeller that is positioned in the pipe arrangement and is rotated by the fluid stream flowing through the pipe arrangement.

14. The subsea cooling apparatus of claim 11, wherein the rotating means comprises a second propeller which is positioned in the pipe arrangement and is rotated by the fluid stream flowing through the pipe arrangement.

15. The subsea cooling apparatus of claim 14, wherein the first propeller is connected to the second propeller via a shaft which extends through a wall of the pipe arrangement.

16. The subsea cooling apparatus of claim 15, wherein the shaft is rotatably supported in a second generally straight pipe which extends through the wall of the pipe arrangement.

17. The subsea cooling apparatus of claim 14, wherein the first propeller is magnetically coupled to the second propeller such that rotation of the second propeller induces rotation of the first propeller.

18. The subsea cooling apparatus of claim 14, wherein the rotating means further comprises a motor which is powered by a generator that is energized by the second propeller.

19. The subsea cooling apparatus of claim 11, further comprising a controller for controlling the rotation of the first propeller in response to at least one of a pressure or temperature of the fluid stream flowing through the pipe arrangement.

20. The cooling unit according to claim 1, wherein the actuator comprises a second propeller which is positioned in the piping arrangement and is rotated by the fluid stream.

21. The cooling unit according to claim 20, wherein the actuator further comprises a motor which is powered by a generator that in turn is energized by rotation of the second propeller.

22. The cooling unit of claim 20, wherein the actuator further comprises a mechanical linkage between the first and second propellers such that rotation of the second propeller rotates the first propeller.

* * * * *